US012635798B2

(12) United States Patent
Jung

(10) Patent No.: US 12,635,798 B2
(45) Date of Patent: May 26, 2026

(54) MESH SEAT FOR CHAIRS WITH EASY INSTALLATION OF MESH FABRIC AND CHAIR INCLUDING THE SAME

(71) Applicant: PATRA CO., LTD., Yongin-si (KR)

(72) Inventor: Jae Gyu Jung, Seoul (KR)

(73) Assignee: PATRA CO., LTD., Yongin-si (KR)

( * ) Notice: Subject to any disclaimer, the term of this patent is extended or adjusted under 35 U.S.C. 154(b) by 167 days.

(21) Appl. No.: 18/590,506

(22) Filed: Feb. 28, 2024

(65) Prior Publication Data

US 2025/0017379 A1 Jan. 16, 2025

(30) Foreign Application Priority Data

Jul. 11, 2023 (KR) ..... 10-2023-0089752

(51) Int. Cl.
*A47C 7/14* (2006.01)
*A47C 31/00* (2006.01)

(52) U.S. Cl.
CPC ..... *A47C 7/14* (2013.01); *A47C 31/006* (2013.01)

(58) Field of Classification Search
CPC ..... A47C 7/282
See application file for complete search history.

(56) References Cited

U.S. PATENT DOCUMENTS

2001/0030457 A1* 10/2001 Gregory ..... A47C 5/06 297/440.11
2018/0338623 A1* 11/2018 Winterhalter ..... A47C 4/10

FOREIGN PATENT DOCUMENTS

KR 101383921 B1 * 4/2014 ..... A47C 5/06
KR 10-1603925 B1 3/2016
KR 10-1885598 B1 8/2018
KR 10-2018135 B1 9/2019
KR 102088455 B1 * 5/2020 ..... A47C 31/023
KR 20200122079 A * 10/2020 ..... A47C 5/06
KR 102180232 B1 * 11/2020 ..... A47C 31/023
KR 102180233 B1 * 11/2020 ..... A47C 5/06
KR 20200130959 A * 11/2020 ..... A47C 7/02
KR 10-2023-0085483 A 6/2023

OTHER PUBLICATIONS

Translation of KR 101383921 (Year: 2014).*
Translation of KR 102088455 (Year: 2020).*
Translation of KR 102180232 (Year: 2020).*
Translation of KR 102180233 (Year: 2020).*
Translation of KR 20200122079 (Year: 2020).*
Translation of KR 20200130959 (Year: 2020).*

* cited by examiner

*Primary Examiner* — Joshua J Michener
*Assistant Examiner* — Ryan Andrew Yankey
(74) *Attorney, Agent, or Firm* — You & IP, LLC

(57) ABSTRACT

A mesh seat for chairs with easy installation of a mesh fabric is disclosed. The mesh seat comprises a mesh fabric having a fixing rod forming a rim end of the fabric, and a seat frame including a main frame with a pair of lateral side frames and a single rear side frame. A rim frame extends along the outer periphery of the main frame and includes a fitting line along its inner side, the fitting line receiving the fixing rod of the mesh fabric. Sliding coupling parts are provided at free ends of the lateral side frames, and a seat front bar engages the sliding coupling parts to maintain a predetermined interval between the free ends. The tension of the installed mesh fabric is adjustable to support a user's body weight.

10 Claims, 10 Drawing Sheets

MESH SEAT FOR CHAIRS WITH EASY INSTALLATION OF MESH FABRIC AND CHAIR INCLUDING THE SAME

CROSS-REFERENCE TO RELATED APPLICATIONS

This application claims the priority of Korean Patent Application No. 10-2023-0089752 filed on Jul. 11, 2023, in the Korean Intellectual Property Office, the disclosure of which is incorporated herein by reference.

BACKGROUND

Field

The present disclosure relates to seats for chairs with easy installation of a mesh fabric and a chair including the same, and more particularly, to seats for chairs with easy installation of a mesh fabric and a chair including the same, in which the mesh fabric may be tightly installed by horizontally sliding-coupling a seat front bar to a seat frame so that a user's body weight may be supported.

Description of the Related Art

Recently, as living environments have become gradually westernized, the trend is that an increasing number of people spend their time sitting in a chair. In particular, office workers and students spend most of their time sitting in chairs, so they appreciate more comfortable and stable chairs, and the functional importance of chairs has become very important.

Recently, the number of consumers seeking functional chairs has increased. For example, as the functional chairs with various shapes, chairs having breathable mesh fabrics with a mesh sheet material applied to a seat, a backrest, or both the seat and the backrest are widely used.

The mesh seat in the related art is configured such that a rim of a mesh fabric is fixed along a periphery of the seat frame having a circular, elliptical, or quadrangular shape so that the mesh fabric is tensely maintained.

However, the mesh seat in the related art is assembled by fixedly installing one side of the mesh fabric to the seat frame, tensely pulling the mesh fabric, and fixing the other side of the mesh fabric to the seat frame, which makes it difficult to assemble and install the mesh fabric and increases the working time.

In particular, the tension of the mesh fabric of the mesh seat needs to be constantly maintained in order to elastically support a user's body weight. However, in the case of the mesh seat in the related art, the mesh fabric is torn by an excessive pulling force during an assembling process, which causes a product defect. Further, a difference in tension of the mesh fabric is caused by the force that pulls the mesh fabric, which makes it impossible to maintain uniform quality.

In particular, the mesh seat in the related art causes several problems in that a separate device for fixing the seat frame while pulling the mesh fabric needs to be installed.

DOCUMENTS OF RELATED ART

Patent Documents (Patent Document 1) Korean Patent Application Laid-Open No. 10-2023-0085483 (Jun. 14, 2023)

(Patent Document 2) Korean Patent No. 10-1885598 (Jul. 31, 2018)

(Patent Document 3) Korean Patent No. 10-1603925 (Mar. 10, 2016)

(Patent Document 4) Korean Patent No. 10-2018135 (Aug. 29, 2019)

SUMMARY

An object to be achieved by the present disclosure is to provide a mesh seat with easy installation of a mesh fabric, in which the mesh fabric may be easily installed while tension of the mesh fabric is increased by horizontal fitting of a seat front bar to a seat frame.

Another object to be achieved by the present disclosure is to provide a mesh seat and a chair including the same, in which a mesh fabric is tightly supported, a user's thigh is supported by tension of the mesh fabric without coming into contact with a frame, and a user's thigh is not strained.

The present disclosure provides a mesh seat for chairs with easy installation of a mesh fabric, the mesh seat including: a mesh fabric; a '⊏'-shaped seat frame having a fitting line provided along an outer periphery thereof so that a rim end of the mesh fabric is fitted with the fitting line, the seat frame having sliding coupling parts provided inside two opposite ends thereof; and a seat front bar configured to support the seat frame so that a predetermined interval is maintained between the two opposite ends of the seat frame as coupling parts provided at two opposite ends are fitted with the sliding coupling parts of the seat frame while horizontally moving in a forward direction (F), in which when the seat front bar is horizontally coupled, the two opposite ends of the seat frame are supported while being spread in an outward direction, such that tension of the mesh fabric installed on the seat frame is adjusted so that a user's body weight is supported.

According to the present disclosure, the seat front bar is sliding-fitted with the '⊏'-shaped seat frame in the horizontal direction, such that the tension of the mesh fabric installed on the seat frame may be easily and automatically adjusted.

According to the present disclosure, the tension of the mesh fabric may be automatically adjusted as the seat front bar is fitted with the seat frame. The process of installing the mesh fabric may be easily performed, the mesh seats may be mass-produced, and a tension defect hardly occurs, such that a defect rate of a mesh chair product may be minimized, and the tension of the mesh fabric may be constantly maintained.

According to the present disclosure, the seat front bar is slidably coupled to the seat frame while being guided by the inclined guide portion, such that the tension of the mesh fabric may be adjusted, and the seat front bar may be easily assembled to the seat frame.

According to the present disclosure, the seat front bar is screw-coupled to the seat frame by the coupling flange by dual engagement, such that a coupling/supporting force of the seat front bar to the seat frame may be improved.

According to the present disclosure, when the tension of the mesh fabric decreases, the mesh fabric may be easily replaced and repaired only by separating the seat front bar from the seat frame.

According to the present disclosure, the front fitting line of the fitting line, with which the mesh fabric is fitted, has a 'C' or '⊏'-shaped structure rounded downward, and the seat front bar is structured to have the spacing gap G with the front fitting line, such that an elastic force of the mesh fabric may be naturally provided to a seated person, and a comfortable seating quality may be provided without applying a sense of pressure to a thigh of the seated person.

According to the present disclosure, the fitting line and the fitting groove are provided on the seat frame and the seat front bar, such that the tension of the mesh fabric may be constantly maintained and adjusted, and the seat may be replaced with not only the mesh fabric but also the seat made of a fabric material.

BRIEF DESCRIPTION OF THE DRAWINGS

The above and other aspects, features and other advantages of the present device will be more clearly understood from the following detailed description taken in conjunction with the accompanying drawings, in which.

DETAILED DESCRIPTION OF THE EMBODIMENT

Figure 1A:
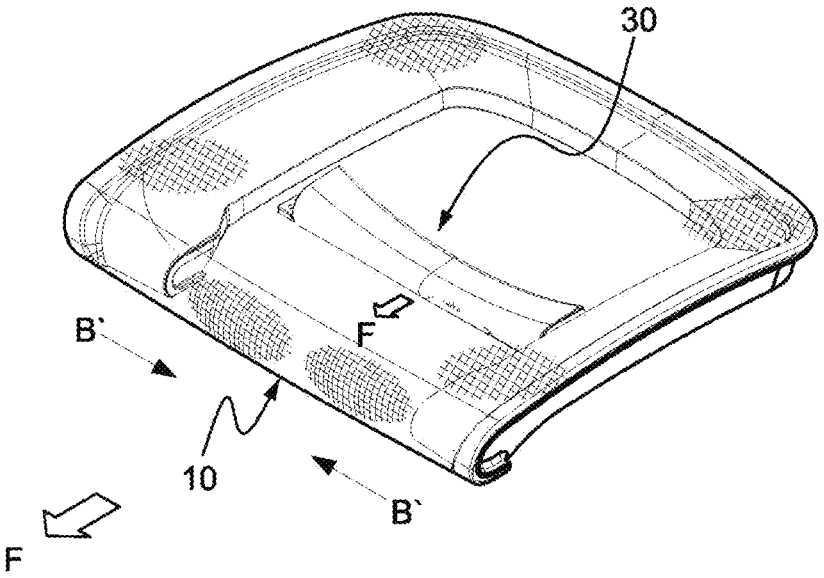
FIGS. 1A and 1B are an exemplified view illustrating a configuration according to the present disclosure.
Figure 1B:
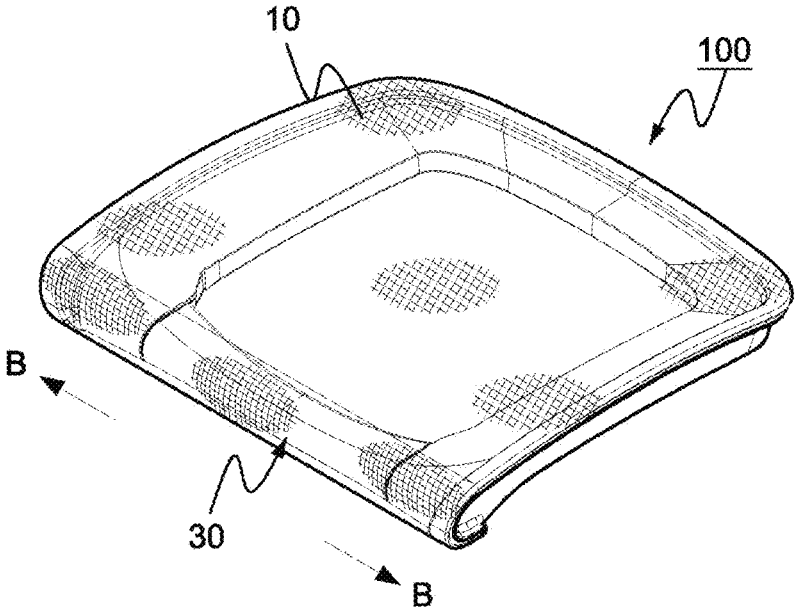
Figure 2A:
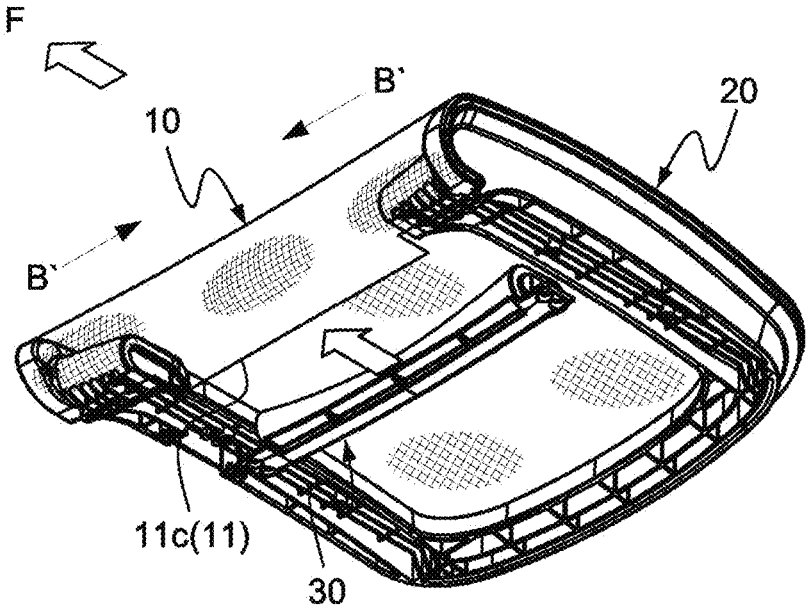
FIGS. 2A and 2B are another exemplified view illustrating the configuration according to the present disclosure.
Figure 2B:
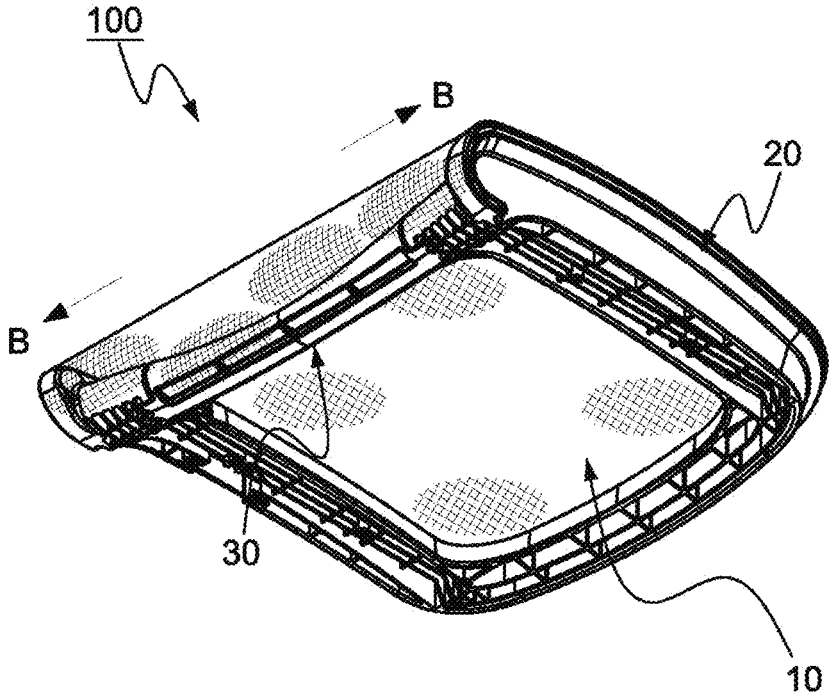
Figure 3A:
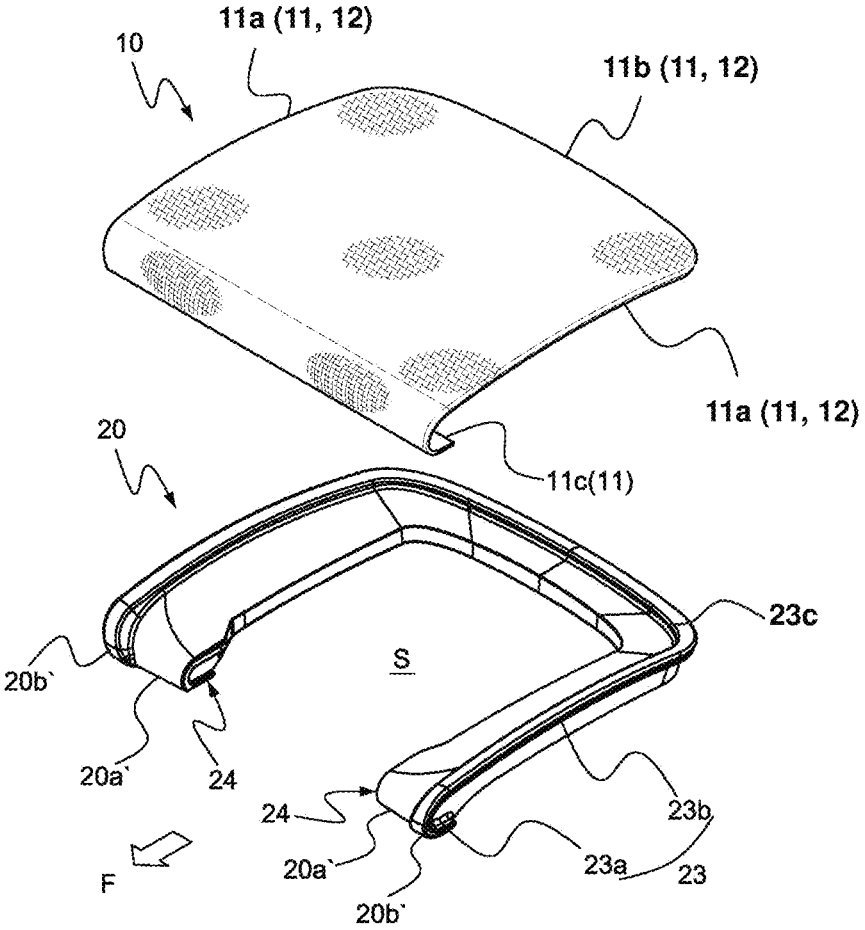
FIGS. 3A and 3B are exemplified views illustrating an assembly relationship between a mesh fabric and a seat frame according to the present disclosure.
Figure 3B:
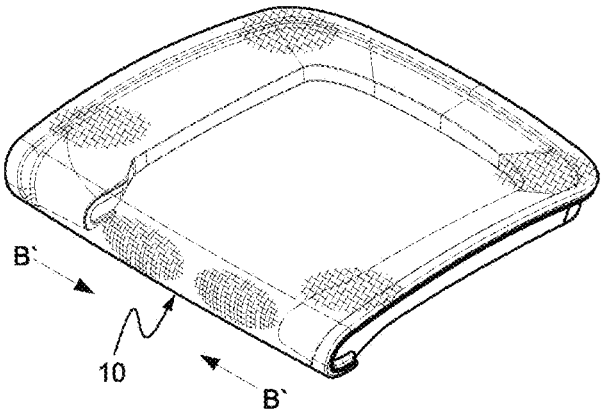
Figure 4A:
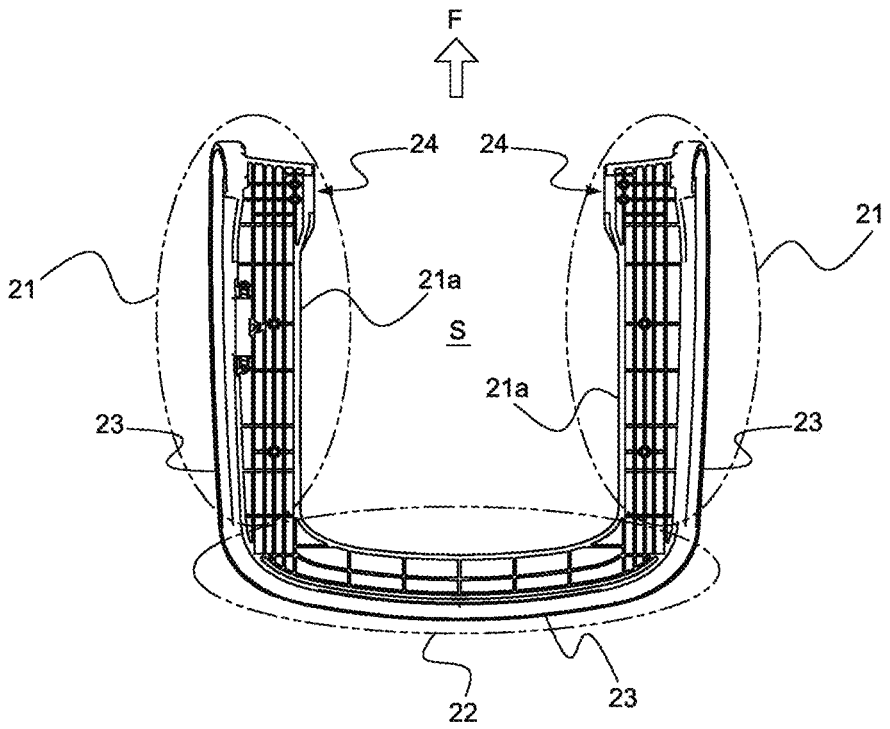
FIGS. 4A and 4B are exemplified views illustrating a configuration of the seat frame according to the present disclosure.
Figure 4B:
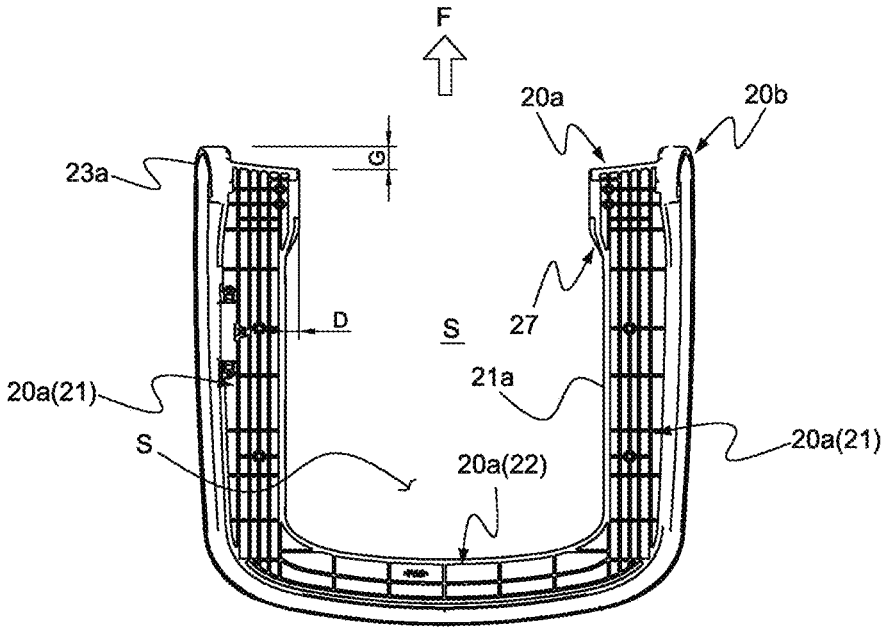
Figure 5A:
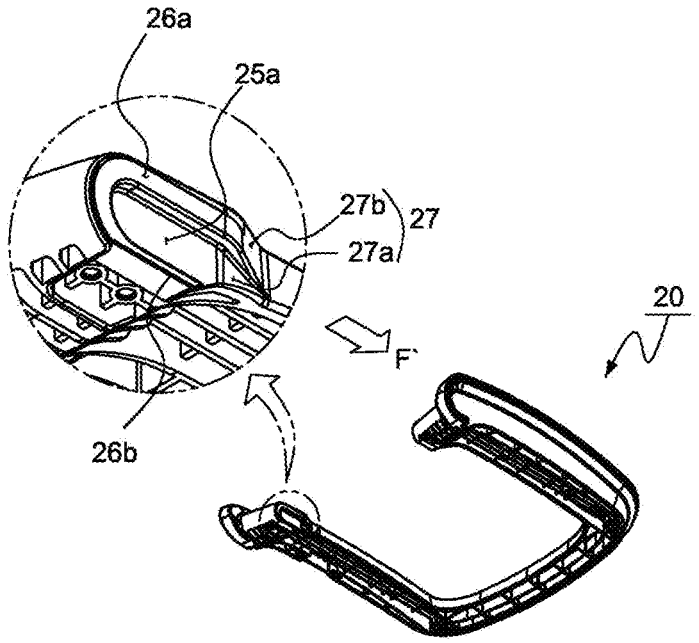
FIGS. 5A and 5B are another exemplified view illustrating the configuration of the seat frame according to the present disclosure.
Figure 5B:
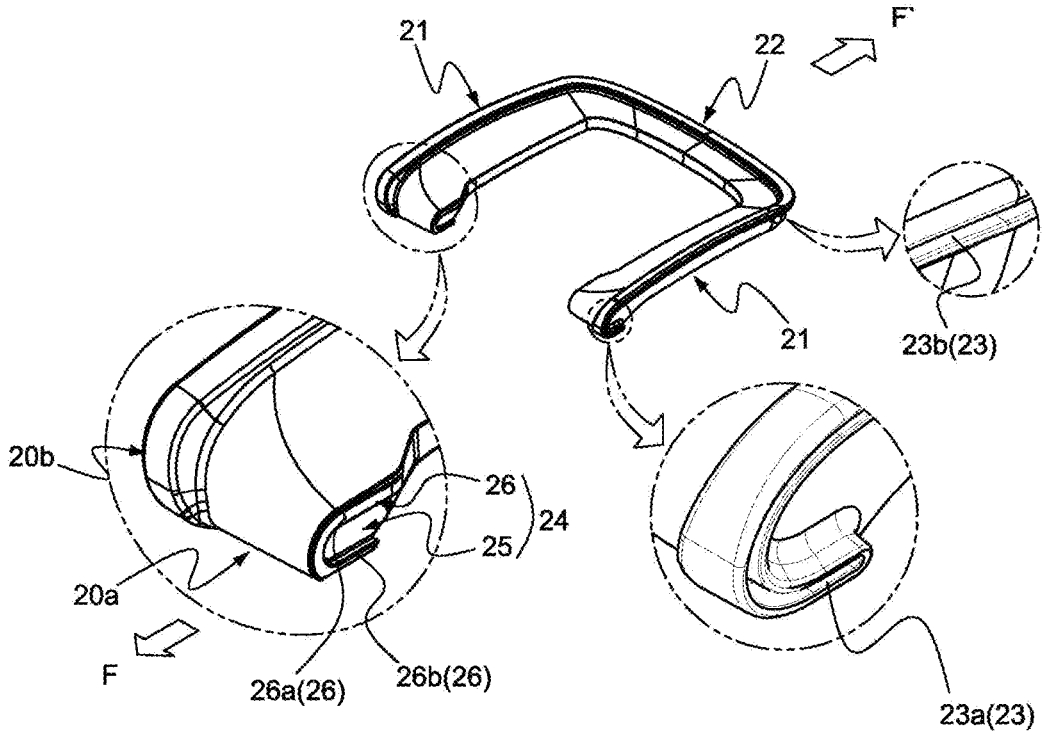
Figure 6A:
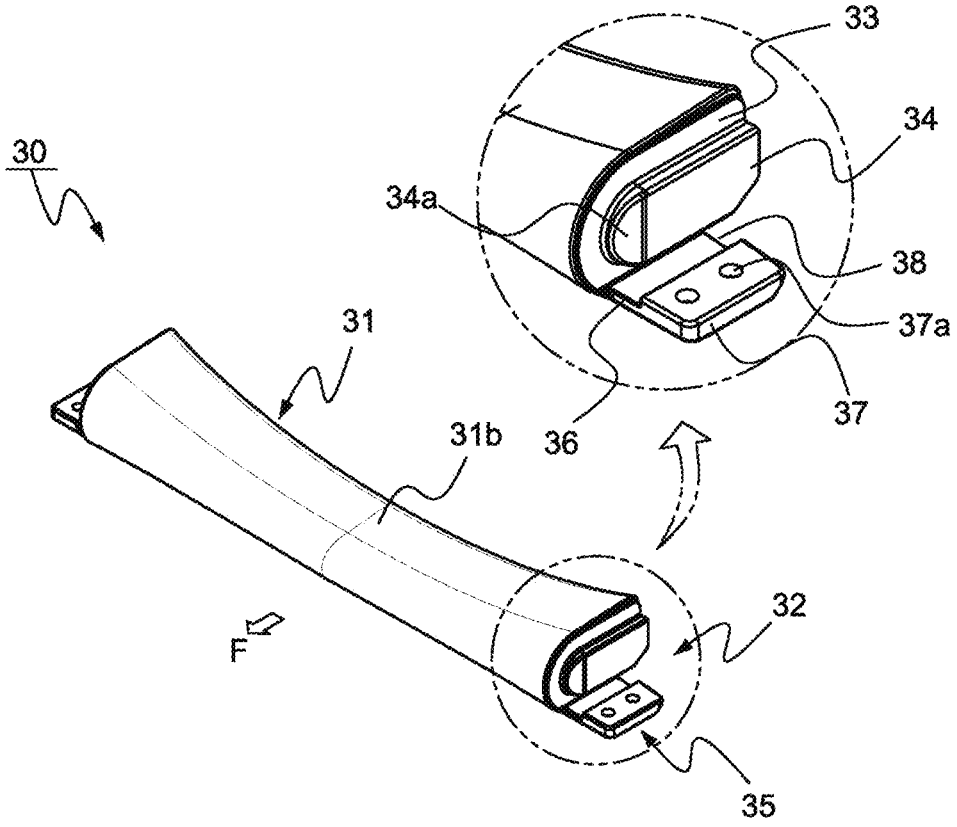
FIGS. 6A and 6B are an exemplified view illustrating a configuration of a seat front bar according to the present disclosure.
Figure 6B:
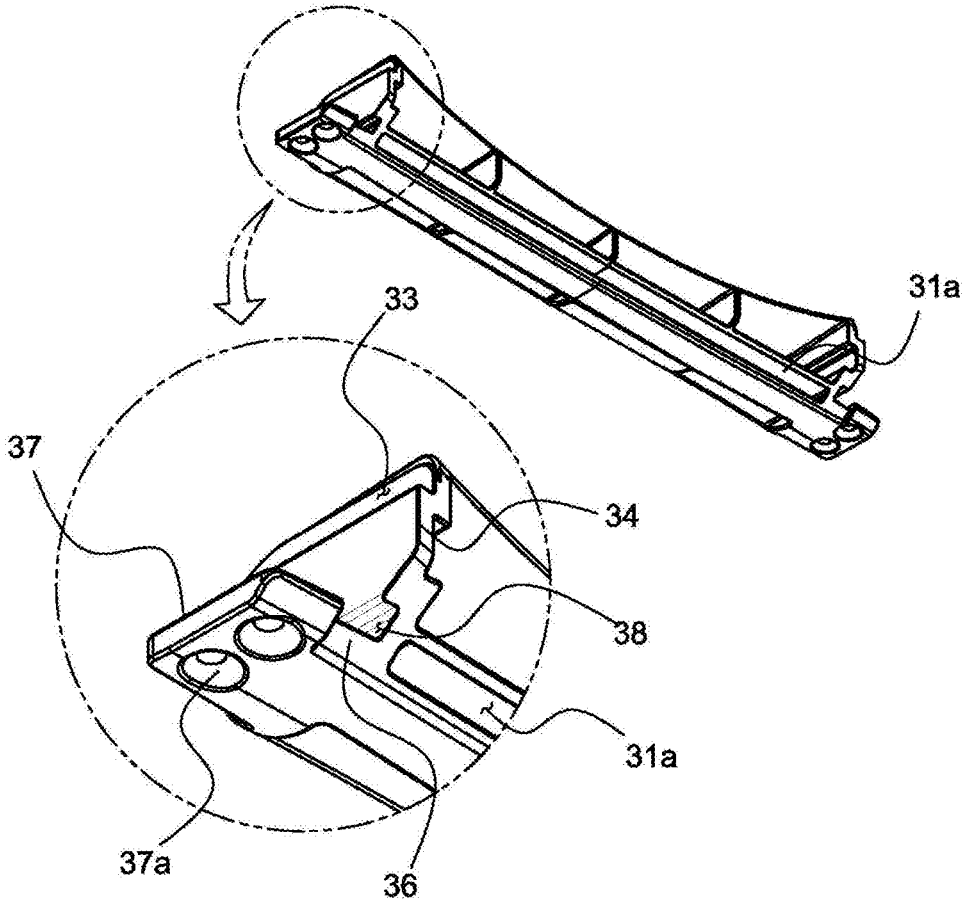
Figure 7A:
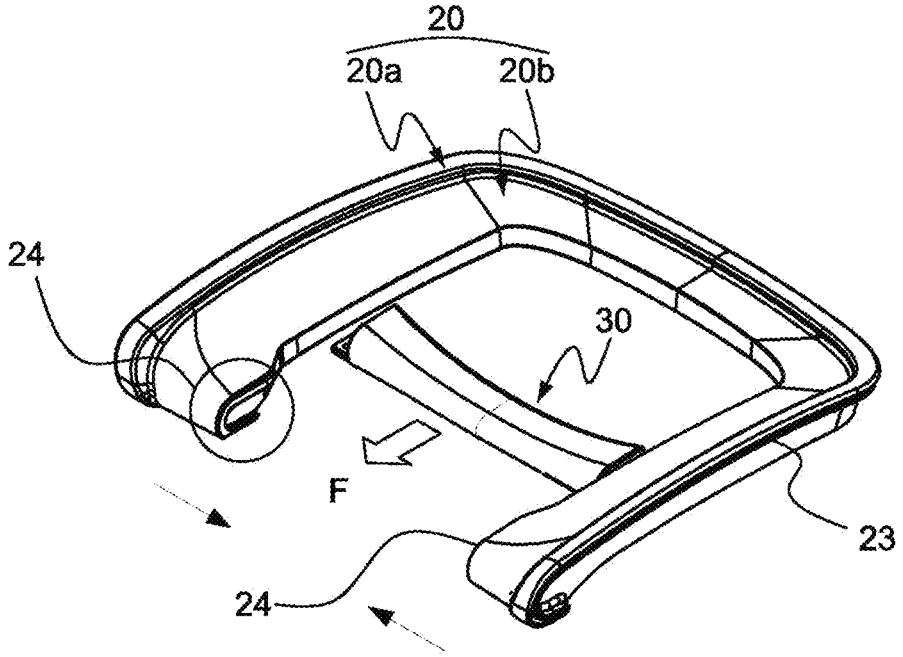
FIGS. 7A and 7B are an exemplified view illustrating a relationship between the seat frame and the seat: front bar according to the present disclosure.
Figure 7B:
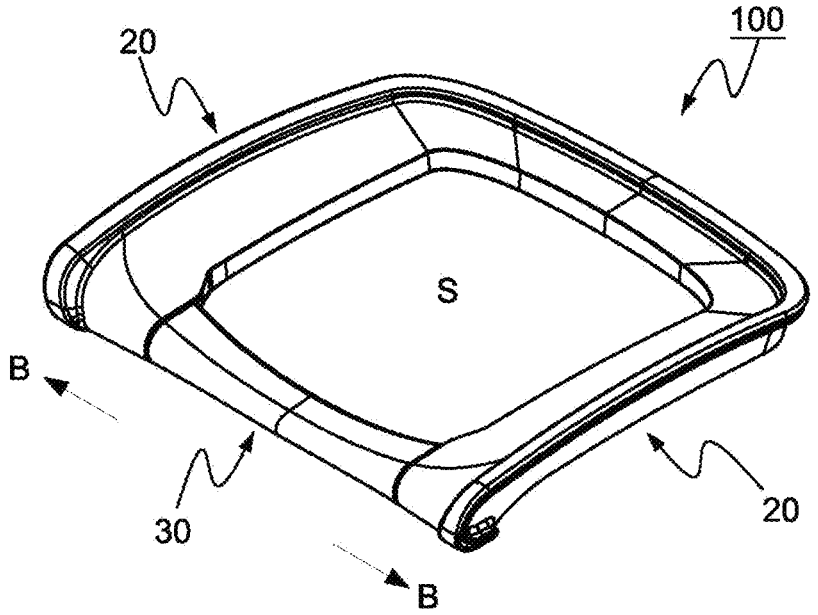
Figure 8:
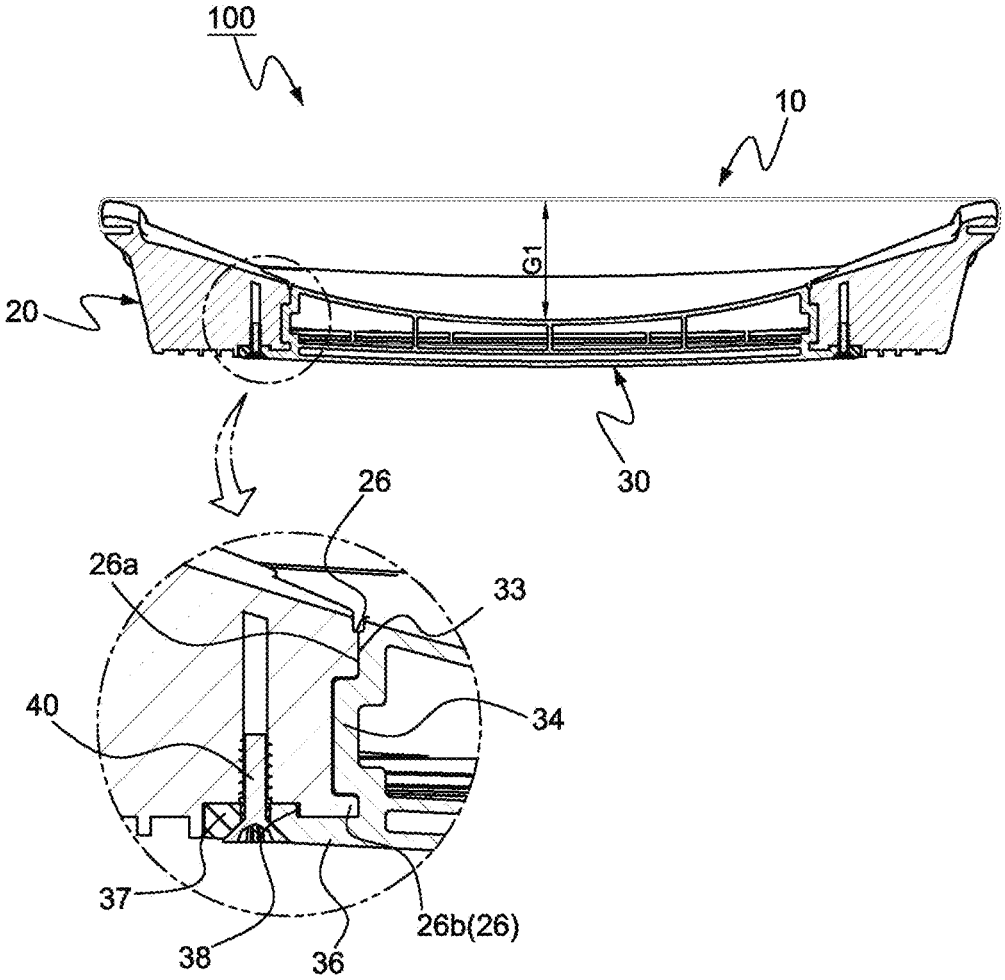
FIG. 8 is an exemplified view illustrating an assembled configuration of a mesh seat according to the present disclosure.

FIGS. 1A and 1B are an exemplified view illustrating a configuration according to the present disclosure, FIGS. 2A and 2B are another exemplified view illustrating the configuration according to the present disclosure, FIGS. 3A and 3B are exemplified views illustrating an assembly relationship between a mesh fabric and a seat frame according to the present disclosure, FIGS. 4A and 4B are exemplified views illustrating a configuration of the seat frame according to the present disclosure, FIGS. 5A and 5B are another exemplified view illustrating the configuration of the seat frame according to the present disclosure, FIGS. 6A and 6B are an exemplified view illustrating a configuration of a seat front bar according to the present disclosure, FIGS. 7A and 7B are an exemplified view illustrating a relationship between the seat frame and the seat front bar according to the present disclosure, and FIG. 8 is an exemplified view illustrating an assembled configuration of a mesh seat according to the present disclosure.

The present disclosure includes a mesh fabric 10, a '⊏'-shaped seat frame 20 having a fitting line 23 provided along an outer periphery thereof so that a rim end of the mesh fabric 10 is fitted with the fitting line 23, the seat frame 20 having sliding coupling parts 24 provided inside two opposite ends thereof, and a seat front bar 30 configured to support the seat frame so that a predetermined interval is maintained between the two opposite ends of the seat frame as coupling parts 32 provided at two opposite ends are fitted with the sliding coupling parts 24 of the seat frame 20 while horizontally moving in a forward direction F. When the seat front bar is horizontally coupled, the two opposite ends of the seat frame are supported while being spread in an outward direction B, such that tension of the mesh fabric 10 installed on the seat frame is adjusted so that a user's body weight may be supported.

The mesh fabric 10 is made of fiber, resin, or a composite material including a mixture thereof and includes a woven fabric or knitted fabric made of a mesh sheet material having predetermined elasticity (tension) and breathability. In addition, a fixing rod (12) is installed at a rim end 11 of the mesh fabric 10 and used to fixedly install the mesh fabric 10 into the fitting line of the seat frame. In this case, the fixing rod (12) may be provided in the form of a rod or bar and made of a synthetic resin material or a metallic material. Because the installation of the fixing rod is a publicly-known technology, a detailed description thereof will be omitted.

As illustrated in FIGS. 1 to 5, the seat frame 20 has a '⊏'-shaped flat frame structure having a space portion S opened in the forward direction F. The fitting line 23 with which the rim end 11 of the mesh fabric is fitted is provided along the outer periphery of the seat frame 20. The seat frame 20 has the sliding coupling parts 24 provided inside the two opposite ends that are free ends, such that the seat front bar 30 is coupled to the sliding coupling parts 24.

That is, as illustrated in FIG. 4A, the seat frame 20 may have a '⊏'-shaped flat structure including a pair of lateral end frames 21 and a single rear end frame 22 and having two opposite ends that are free ends. The fitting line 23 is provided along outer peripheries of the lateral end frames 21 and the rear end frame 22. The sliding coupling parts 24, to which the seat front bar 30 is coupled, are provided on inner portions of the two opposite ends of the lateral end frames 21, which are free ends, i.e., provided on inner portions of the lateral end frames in the forward direction F.

In order to assist in understanding the present disclosure, the pair of lateral end frames 21 and the rear end frame 22 are described as being separated. The pair of lateral end frames 21 and the rear end frame 22 may be integrated and define the single seat frame 20 instead of being separately formed and assembled.

In addition, as illustrated in FIG. 4B, the seat frame 20 may include a main frame 20*a* on which the sliding coupling parts 24 are provided, and a rim frame 20*b* protruding along an outer periphery of the main frame 20*a* and having the fitting line 23.

That is, the main frame 20*a* may include the pair of lateral end frames 21 and the rear end frame 22, and the rim frame 20*b* may be integrated so as to protrude along the outer peripheries of the pair of lateral end frames 21 and the rear end frame 22.

The fitting line 23 has a predetermined depth so that the rim end 11 of the mesh fabric is fitted with the fitting line 23. As illustrated in FIGS. 3A, 3B and 5, the fitting line 23 is formed along the outer periphery of the seat frame 20 and includes a pair of front fitting lines 23*a* and a single rear fitting line 23*b* connected to the pair of front fitting lines 23*a*.

The fitting line 23 may include the pair of front fitting lines 23*a* having a 'C' or '⊏' shape and provided on outer portions of the two opposite ends of the seat frame (outer portions of the lateral end frames in the forward direction F), and the rear fitting line 23*b* extending from the front fitting lines 23*a* and formed along the outer periphery of the seat frame 20 (the outer peripheries of the pair of lateral end frames and the rear end frame). In this case, the rear fitting line 23*b* is connected to and communicates with upper end portions of the pair of front fitting lines 23*a* having a 'C' or '⊏' shape.

In addition, the fitting line 23 may have a structure having a straight line, a curved line, or a mixture of a straight line and a curved line.

In addition, in case that the seat frame 20 includes the main frame 20*a* and the rim frame 20*b*, the rim frame 20*b* protrudes along the outer periphery of the seat frame 20 so that the pair of front fitting lines 23*a* and the single rear fitting line 23*b* are provided.

The two opposite ends of the seat front bar 30 are slidably fitted with and supported by the sliding coupling parts 24. As illustrated in FIGS. 5A and 5B, the sliding coupling part 24 includes a coupling groove 25 opened in a rearward direction F', and a coupling protrusion 26 having a '⊏' shape and configured to surround the coupling groove 25.

The two opposite ends of the seat front bar 30 are tightly fitted with the coupling grooves 25 while horizontally moving. The coupling groove 25 has a horizontal groove structure having a predetermined length.

The coupling protrusion 26 is formed along a periphery of the coupling groove 25. The coupling protrusions 26 serve to support the two opposite ends of the seat front bar 30 introduced into the coupling grooves 25 and restrict the movements of the seat front bar 30 in the upward/downward direction and the forward direction F.

In addition, as illustrated in FIG. 4B, the sliding coupling part 22 may protrude in the direction toward the space portion S while having a level difference D from an inner surface of the seat frame, i.e., an inner surface 21*a* of the lateral end frame.

As described above, in case that the sliding coupling part 22 is formed to have the level difference D from the inner surface 21*a* of the lateral end frame, the sliding coupling part 22 and the inner surface 21*a* of the lateral end frame are connected by an inclined guide portion 27, such that the horizontal movement and coupling of the seat front bar 30 to the sliding coupling part 22 may be smoothly performed.

The inclined guide portion 27 has an inclined surface so that the seat front bar 30 is smoothly guided to and fitted with the sliding coupling part 22 without being caught by the level difference D when the seat front bar 30 is slidably coupled.

That is, as illustrated in FIGS. 5A and 5B, the inclined guide portion 27 may include an inner surface guide 27*a* extending from the inner surface 21*a* of the lateral end frame to a coupling groove inner surface 25*a* provided in the coupling groove 25 of the sliding coupling part, and a protrusion guide 27*b* extending from the inner surface 21*a* of the lateral end frame to an outer surface 26*a* provided on the coupling protrusion 26 of the sliding coupling part.

The inclined guide portion 27 configured as described above serves to guide the seat front bar 30 so that the seat front bar 30 is easily fitted with the seat frame 20 while maintaining the constant tension of the mesh fabric.

In addition, as illustrated in FIGS. 4B and 5, the seat frame 20 is formed such that the front fitting line 23*a* having the fitting line having a 'C' shape is formed to be positioned, in the forward direction F, forward of the coupling protrusion 26 of the sliding coupling part having a 'C' shape.

For example, in case that the seat frame 20 includes the main frame 20*a* having the sliding coupling part 24 and the rim frame 20*b* having the fitting line 23, the rim frame 20*b* may further protrude in the forward direction F than the main frame 20*a* so that a spacing gap G is provided.

The spacing gap G prevents the mesh fabric 10 from coming into contact with the main frame 20*a* having the sliding coupling part 24 and the seat front bar 30 fitted with the sliding coupling part 24 when the mesh fabric 10 is installed on the front fitting line 23*a* of the fitting line. Therefore, when the user is seated on the seat frame 20 on which the mesh fabric 10 is mounted, the mesh fabric 10 may resiliently support the user's thigh without providing a sense of pressure, thereby improving the user's convenience.

In addition, as illustrated in FIGS. 1 to 3 and 5, the two opposite ends, i.e., the lateral end frames 21 of the seat frame 20 may be formed so that the front fitting line 23*a* of the fitting line has a 'C' or '⊏'-shaped structure rounded downward.

In addition, although not illustrated, the seat frame 20 is connected to or equipped with a seat sliding bracket for improving a convenience for the seat seat, a seat lever for adjusting sliding, and a tilting part for tilting a chair backrest.

As illustrated in FIG. 3, in the seat frame 20 configured as described above, in case that the mesh fabric 10 is mounted on the seat frame 20 as a rim lateral end 11*a* and a rim rear end 11*b* of the mesh fabric 10 are fitted into the front fitting line 23*a* and the rear fitting line 23*b* of the fitting line, the ends of the lateral end frames, which are free ends (the two opposite ends at which the sliding coupling parts 24 are provided), are collected in an inward direction B', i.e., the direction toward the space portion S of the seat frame 20 by the tension of the mesh fabric 10.

As illustrated in FIGS. 1 to 3, 7, and 8, the coupling parts 32 provided at the two opposite ends of the seat front bar 30 are fitted with the seat frame 20 on which the mesh fabric 10 is mounted, thereby supporting the two opposite ends of the seat frame 20 that are free ends, and constantly maintaining and adjusting the tension of the mesh fabric 10 in order to support the user's body weight.

That is, the seat front bar 30 is horizontally slidably coupled to the seat frame 20 having a '⊏' shape, such that a '⊔'-shaped frame structure having the space portion S therein is formed, thereby constantly maintaining the tension of the mesh fabric 10 and stably supporting the mesh fabric 10.

As illustrated in FIGS. 6A and 6B, the seat front bar 30 includes a body part 31, and the coupling parts 32 provided at the two opposite ends of the body part 31 and coupled to the sliding coupling parts.

The body part 31 is formed to have a predetermined length and serves to maintain and support a predetermined interval between the two opposite ends, i.e., the pair of lateral end frames 21 of the seat frame 20.

The body part 31 has a slit type fitting groove 31*a* formed in a longitudinal direction so that a rim front end 11*c* of the mesh fabric 10 is fitted with the slit type fitting groove 31*a*.

That is, in the present disclosure, the rim lateral end 11*a* and the rim rear end 11*b* of the mesh fabric are fitted with the fitting line 23 of the seat frame, and the rim front end 11*c* of the mesh fabric is fixedly fitted with the fitting groove 31*a* of the seat front bar, such that the supporting force and tension of the mesh fabric 10 are stably maintained.

In addition, in the present disclosure, four sides of the seat are fixedly supported by the fitting line 23 and the fitting groove 31*a*, such that the seat may be installed by being replaced with the mesh fabric or a seat made of a fabric material. That is, in the case of the mesh fabric, the mesh fabric may be sufficiently supported only by the fitting line 23 having a '⊏' shape. However, in the present disclosure, the fitting groove 31*a* may be further provided on the seat front bar, such that the supporting force and tension of the mesh fabric may be stably maintained, or the seat may be easily replaced with the seat made of a fabric material.

In addition, as illustrated in FIG. 8, a body part upper end 31*b* of the body part 31 is formed to have a curved structure, which is concave in the longitudinal direction, so that the body part upper end 31*b* is spaced apart from the mesh fabric 10 by a predetermined distance G1 in the upward/downward direction. That is, in case that the user is seated on the mesh fabric 10, the body part 31 has a curved structure so that a longitudinal central portion of the body part upper end 31*b* is concave, and the mesh fabric 10 does not come into contact with the body part 31 of the seat front bar 30 by the user's load (the user's load is not transmitted to the body part).

As illustrated in FIGS. 6A and 6B, the coupling part 32 may include a sliding support part 33 provided to be in surface contact with the coupling protrusion 26 of the sliding coupling part and configured to move, and a coupling block 34 protruding from the sliding support part 33 and configured to be fitted into the coupling groove 25 of the sliding coupling part.

That is, the coupling part 32 has a structure in which the sliding support part 33 having a '⊏' shape is provided along the periphery of the coupling block 34, and as illustrated in FIGS. 7 and 8, the coupling part 32 is tightly fitted with the sliding coupling part 24 in the horizontal direction.

In addition, as illustrated in FIGS. 6A and 6B, the coupling block 34 has a block tip 34*a* positioned in the forward direction F, and the block tip 34*a* is formed to have an inclined surface tapered toward the body part 31, such that the coupling block 34 may be smoothly fitted into the coupling groove 25.

As illustrated in FIGS. 1, 2, and 7, the seat front bar 30 is configured such that the coupling block 34 is tightly fitted into the coupling groove 25 of the sliding coupling part by the horizontal movement in the forward direction F, and the sliding support part 33 is tightly attached to the coupling protrusion 26 of the sliding coupling part and tightly coupled to the seat frame 20 without a gap, as illustrated in FIG. 8.

In addition, as illustrated in FIGS. 6A and 6B, the seat front bar 30 may further include coupling flanges 35 provided on the coupling parts 32.

The coupling flanges 35 allow the seat front bar 30 to be fastened to the seat frame 20 by dual engagement and screw-fastening, thereby increasing a coupling supporting force of the seat front bar 30 to the seat frame 20.

The coupling flange 35 may include an extension flange 36 having one side integrally connected to the body part 31 and having a support guide groove 38 into which the coupling protrusion 26 of the sliding coupling part is inserted, and a fastening flange 37 integrally formed at the other side of the extension flange 36 and screw-fastened to the seat front.

That is, the coupling flange 35 is configured such that the body part 31 and the fastening flange 37 are integrally connected by the extension flange 36 so that the support guide groove 38 is positioned between the body part 31 and the fastening flange 37.

The support guide groove 38 is formed such that a lower end 26*b* of the coupling protrusion is fitted with the support guide groove 38 in the horizontal direction, and the fastening flange 37 has one or more fastening holes 37*a* so that the fastening flange 37 is in surface contact with and screw-fastened to a lower surface of the seat frame 20.

In the present disclosure, in case that the coupling flange 35 is further provided on the seat front bar 30, the coupling part 32 of the seat front bar is coupled to the sliding coupling part 24 of the seat frame in the horizontal direction and screw-fastened by an assembling screw 40. Therefore, as illustrated in FIG. 8, the seat front bar is screw-fastened to the seat frame by the dual engagement including the coupling between the coupling groove 25 and the coupling block 34 and the coupling between the lower end 26*b* of the coupling protrusion and the support guide groove 38, such that the supporting force to the user's load is further improved.

According to the present disclosure configured as described above, in a state in which a rim lateral end and a rim rear end of the mesh fabric 10 are fixedly fitted with the seat frame 20, the seat front bar 30 is moved horizontally and coupled to the sliding coupling part 24 of the seat frame. As described above, when the seat front bar 30 is fitted with the seat frame 20 in the horizontal direction, the two opposite ends of the seat frame are supported by the seat front bar 30 while being spread in the outward direction, such that the tension of the mesh fabric is adjusted and maintained.

That is, a mesh seat in the related art is configured such that any one portion of a mesh fabric is coupled to a seat frame, and the remaining part is pulled and coupled to the seat frame, which makes it difficult to install the mesh fabric on the seat frame. In contrast, according to the present disclosure, the seat front bar is fitted with the seat frame in the horizontal direction in the state in which the rim lateral end and the rear end of the mesh fabric are coupled to the seat frame, such that the tension of the mesh fabric may be adjusted to support the user's body weight, a process of installing the mesh fabric may be easily performed, and the working time may be remarkably reduced.

Figure 9:
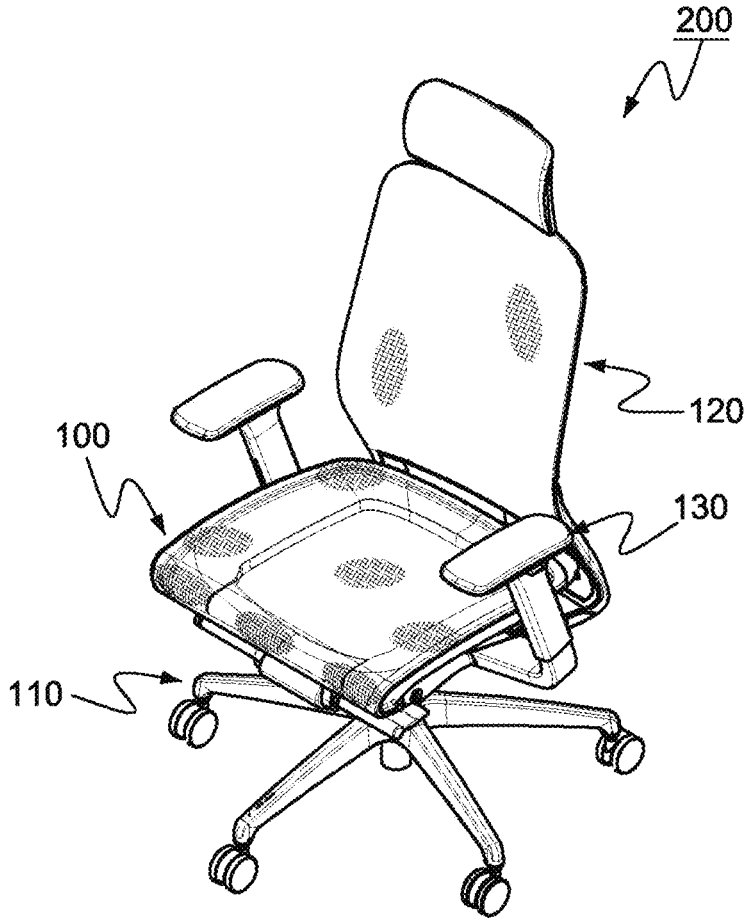
FIG. 9 is an exemplified view illustrating a configuration of a chair on which the mesh seat according to the present disclosure is installed.

FIG. 9 is an exemplified view illustrating a configuration of a chair on which the mesh seat according to the present disclosure is installed. A chair 200 according to the present disclosure may have a structure in which a stationary or movable leg 110 is coupled to a mesh seat 100 for a chair.

In addition, the chair 200 according to the present disclosure may be configured such that the stationary or movable leg 110 is connected to and installed on the mesh seat 100 for a chair, and a backrest 120 is provided at a one side of the mesh seat 100.

In addition, the chair 200 according to the present disclosure may have a structure in which an armrest 130 is further connected to the mesh seat 100 for a chair.

In addition, the chair 200 according to the present disclosure may be configured such that the seat sliding bracket for improving the convenience of the mesh seat, the seat lever for adjusting the sliding, and the tilting part for tilting the chair backrest are positioned between the mesh seat 100 and the leg 110.

The present disclosure is not limited to the specific embodiment described above, various modifications can be made by any person skilled in the art to which the present disclosure pertains without departing from the subject matter of the present disclosure as claimed in the claims, and the modifications are within the scope defined by the claims.

In addition, the terms used to describe the present disclosure are used only for the purpose of distinguishing one constituent element from another constituent element and assisting in understanding the present disclosure, and the constituent elements of the present disclosure should not be limited by the terms.

What is claimed is:

1. A mesh seat for chairs with easy installation of a mesh fabric, the mesh seat comprising:

a mesh fabric including, a fixing rod forming a rim end of the mesh fabric;

a seat frame including a main frame including a pair of lateral side frames and a single rear side frame such that the main frame has a ⊂-shaped configuration that defines a central space portion (S) opened toward a forward direction (F), the pair of lateral side frames each having a predetermined width and a predetermined thickness, and a rim frame provided along an outer periphery of the main frame and comprising a fitting line, the fitting line having a slot formed along an inner side thereof and opened toward the central space portion of the main frame, wherein the fixing rod of the mesh fabric is inserted into the slot, sliding coupling parts provided at respective free ends of the lateral side frames; and a seat front bar configured to engage with the sliding coupling parts of the seat frame and support the seat frame, thereby maintaining a predetermined interval is between the free ends of the lateral side frames, wherein each sliding coupling part has a '⊂' shape when viewed from a lateral side, forms a coupling groove that opens in a rearward direction (F'), and has a width greater than the predetermined width of the lateral side frames, wherein each sliding coupling part includes a coupling protrusion protruding toward the central space portion (S) with a level difference (D) relative to the inner surface of the lateral side frames, and wherein each sliding coupling part further includes an inclined guide portion connecting a top surface of the coupling protrusion and the inner surface of the lateral side frames, wherein the seat front bar comprises:

a body part; and coupling parts configured to be coupled to the sliding coupling parts, and wherein each coupling part comprises:

a sliding support part configured to maintain surface contact with the coupling protrusion of the sliding coupling part; and a coupling block protruding from the sliding support part and configured to engage with the coupling groove of the sliding coupling part.

2. The mesh seat of claim 1, wherein the rim frame is integrated to protrude outward along the outer periphery of the main frame.

3. The mesh seat of claim 2, wherein the rim frame protrudes than the main frame in the forward direction (F) so that a spacing gap (G) is provided between a tip portion of the rim frame and a tip portion of the main frame.

4. The mesh seat of claim 1, wherein the coupling block is formed such that a block tip positioned in the forward direction (F) has an inclined surface tapered toward the body part.

5. The mesh seat of claim 1, wherein a coupling flange is further provided on the coupling part of the seat front bar, wherein the coupling flange comprises:

an extension flange having one side integrally connected to the body part and having a support guide groove into which the coupling protrusion of the sliding coupling part is inserted; and a fastening flange integrated formed at the other side of the extension flange and screw-fastened to the seat front bar, and wherein the seat front bar is fastened to the seat frame by additional screw-fastening.

6. A chair comprising the seat according to claim 1.

7. A chair comprising the seat according to claim 2.

8. A chair comprising the seat according to claim 3.

9. A chair comprising the seat according to claim 4.

10. A chair comprising the seat according to claim 5.

* * * * *